US006571982B2

(12) United States Patent
Yamazaki et al.

(10) Patent No.: US 6,571,982 B2
(45) Date of Patent: Jun. 3, 2003

(54) COMMUNICATION DEVICE FOR AUTOMATIC VENDING MACHINE

(75) Inventors: Yasuhiro Yamazaki, Saitama-Ken (JP); Satoshi Moriyama, Saitama-Ken (JP)

(73) Assignee: Fuji Electric Co., Ltd., Kanagawa (JP)

( * ) Notice: Subject to any disclaimer, the term of this patent is extended or adjusted under 35 U.S.C. 154(b) by 0 days.

(21) Appl. No.: 09/842,213

(22) Filed: Apr. 26, 2001

(65) Prior Publication Data

US 2002/0004689 A1 Jan. 10, 2002

(30) Foreign Application Priority Data

Apr. 26, 2000 (JP) ..... 2000-125304

(51) Int. Cl.[7] ..... G07F 11/00
(52) U.S. Cl. ..... 221/7; 700/241
(58) Field of Search ..... 221/7, 9, 13, 15, 221/92, 131, 129; 700/231, 232, 241

(56) References Cited

FOREIGN PATENT DOCUMENTS

JP A12000057430 * 2/2000

* cited by examiner

*Primary Examiner*—Kenneth W. Noland
(74) *Attorney, Agent, or Firm*—Foley & Lardner

(57) ABSTRACT

A communication device for an automatic vending machine includes, a main control unit that initializes each unit in accordance with a result of decoding an initialization order from ROM, and transmits first to third control data in the form of telegraphic message through a data input/output line to a plurality of button control units one by one. The plural button control units are set to have or not to have a transmission right to the main control unit in accordance with a latch result of the first to third control data. The transmission right of the terminal control units can be set by the main control unit as the automatic vending machine carries a communication between the main control unit and the terminal control unit by contention type protocol.

4 Claims, 2 Drawing Sheets

MAIN CONTROL UNIT
1
10
INPUT CONTROL UNIT
2
COIN PROCESSING CONTROL UNIT
3
CUSTOMER SERVICE CONTROL UNIT
4
VENDING CONTROL UNIT
5
INPUT DEVICE
6
COIN MECHANISM
7
CUSTOMER SERVICE UNIT
8
VENDING MECHANISM
9
ON SALE
STOP
NO CHANGE
103 LAMP
PRESS
SALES POSSIBLE
SOLD OUT
102
102 ITEM SELECTION BUTTON
101 MONEY AMOUNT DISPLAY UNIT

COMMUNICATION DEVICE FOR AUTOMATIC VENDING MACHINE

FIELD OF THE INVENTION

The present invention relates to a communication device for an automatic vending machine, in which communication is carried out by a contention type protocol.

BACKGROUND OF THE INVENTION

A plurality of terminal control units each of which controls each unit such as a customer service unit or a vending unit, and a main control unit which collectively controls the terminal control units are installed in an automatic vending machine. A plurality of terminal control units is set to the predetermined specification and implements a series of vending actions by communication with the main control unit.

A communication system such as a polling type protocol or a contention type protocol is mainly used between the main control unit and the terminal control systems. The main control unit has a prior transmission right in the polling type protocol. That is, the main control unit asks each terminal control unit one by one if it requests a transmission, and only when each terminal control unit requests the transmission, the terminal control unit transmits a data to the main control unit. On the other hand, the main control unit and the terminal control unit have equal transmission rights in the contention type protocol. In a case where either the main control unit or the terminal control units request a transmission prior to the other, one transmits data to the other.

The contention type protocol has been currently used as a communication system between the main control unit and the terminal control units, because a communication time for the data transmission from the terminal control units to the main control unit is shorter in the contention type protocol than in the polling type protocol. An automatic vending machine implementing communication in accordance with the contention type protocol is disclosed in Japanese Patent Application No. 223823/1998 filed by the applicant.

In the Japanese Application No. 223823/1998, an automatic vending machine has a plurality (generally, several tens units) of button control units as a terminal control unit. A plurality of the button control units controls a plurality of item selection buttons which are installed on a front surface of the automatic vending machine. However, under the contention type protocol, if the item selection button is pressed, communication is carried out between the main control unit and the terminal control units, regardless of the situation. For example, in the presence or absence of sold-out display or in the presence or absence of sales possible display, the corresponding button control units always transmit some data to the main control unit. As a result, the button control units transmit meaningless data to the main control unit. This causes such problems that incorrect operations and incorrect vending occur.

SUMMARY OF THE INVENTION

An object of the invention is to provide a communication device for automatic vending machine in which the main control unit can select communication functions of the terminal control units.

This and other objects of the invention can be attained by a communication device for an automatic vending machine having a plurality of terminal control units. Each terminal control unit controls each unit of the automatic vending machine. A main control unit controls the terminal control units. Contention type protocol is used for communication among the main control unit and the terminal control units, where they have equal transmission rights. The main control unit transmits to the terminal control units, a control data that allows or prohibits transmission from the terminal control units at a predetermined timing and the terminal control units set an inside of the terminal control units to the conditions corresponding to the control data. According to the first embodiment of the invention, incorrect operations and incorrect vending can be prevented because some of the terminal control units are set to have the transmission right and the other terminal control units are set not to have the transmission right.

In one aspect of the present invention, the predetermined timing is when the automatic vending machine is initialized by an introduction of electric power. According to this aspect, the terminal control units can be set to the functions corresponding to the specification of each automatic vending machine simultaneously when the electric power is turned on.

In another aspect of the present invention, the terminal control units are plural button control units which control a plurality of item selection buttons.

In a further aspect of the present invention, the control data includes contents to allow or prohibit transmission from the button control units to the main control unit when the item selection buttons are pressed.

In another aspect of the present invention, the control data includes contents to allow or prohibit transmission from the button control units to the main control unit when the item selection buttons are pressed in the state that "sold out" is displayed.

In another aspect of the present invention, the control data includes contents to allow or prohibit transmission from the button control units to the main control unit when the item selection buttons are pressed in the state that "sales possible" is displayed.

In a further aspect of the present invention, some of the button control units are set to have the transmission right and the other button control units are set not to have the transmission right in accordance with sorts of the item selection buttons and presence or absence of "sold out" and "sales possible" display.

BRIEF DESCRIPTION OF THE DRAWINGS

The invention will be explained in more detail in conjunction with the appended drawings, wherein.

DETAILED DESCRIPTION OF THE PREFERRED EMBODIMENTS

Figure 1:
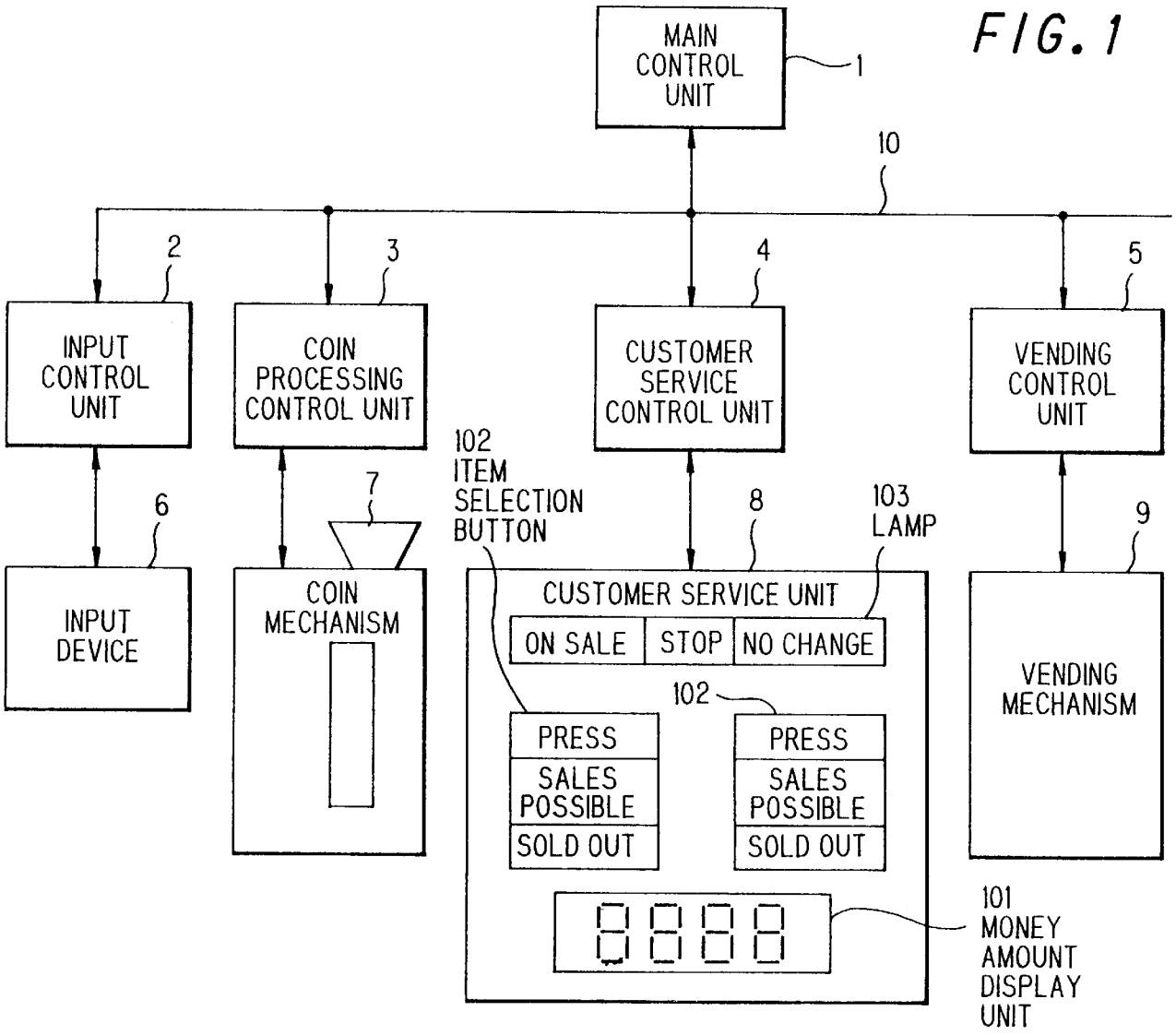
FIG. 1 is a block diagram that illustrates a communication device of an automatic vending machine for vending, for example, a canned drink.

In FIG. 1, a main control unit 1 controls the automatic vending machine collectively and has ROM, CPU and RAM therein. In the ROM of the main control unit 1, the control data that allows or prohibits the transmission from the terminal control units is stored in advance. When an electric power is turned on in the automatic vending machine, the main control unit 1 initializes each unit in accordance with a decoding result of initialization order from the ROM and transmits to the terminal control units by reading out the control data from the ROM. The ROM, CPU, and RAM operating in the transmission correspond to the means of the main control unit 1.

An input control unit 2, a coin processing control unit 3, a customer service control unit 4, and a vending control unit 5 correspond to the terminal control units and each include ROM, CPU, and RAM, same as in the main control unit 1. The main control unit 1 can communicate with the input control unit 2, the coin processing control unit 3, the customer service control unit 4, and the vending control unit 5 which are the plural terminal control units by contention type protocol having equal transmission right. An input device 6 such as a keyboard or a card reader may be used to discriminate customers. A coin mechanism 7 has a no-changes sensor detecting lack of changes, and receives a coin to be put in a coin slot (not shown) which is installed in a front side of the automatic vending machine, for example, and if necessary, returns change from a return opening (not shown) in the front side of the automatic vending machine. The coin processing control unit 3 controls the coin mechanism 7 and implements decisions for the sorts of coins and whether or not the coins are real or false, calculation of the number of coins, accumulation of excess coins in a safe, and payment of changes. In an embodiment, a bill processing control unit and a bill barrier may be present in addition to the coin processing, but are omitted from the explanation herein.

A customer service unit 8 is provided with a money amount display unit 101, a plurality of item selection buttons 102 provided in accordance with kinds of canned drinks, for example, and a lamp 103 displaying "on sale", "stop" and "no changes", for example.

The customer service control unit 4 controls the customer service unit 8. That is, in accordance with customer indication regarding sales of canned drinks and coming from the main control unit 1, the customer control unit 4 switches on or off the lamp 103 which displays "on sale", "stop" and "no changes", for example, and an "on sale" or "sold out" lamp of each vending drink associated with the item selection button. Further, it detects which button in the item selection buttons 102 is pressed and transmits the detected signal to the main control unit 1. A vending mechanism 9 makes a canned drink, which customer wants to buy, move to an item taking-out opening (not shown). The vending control unit 5 controls a vending mechanism 9 and causes an item, which customer wants to buy, move out to the item taking-out opening in accordance with the sales indication from the main control unit 1.

Figure 2:
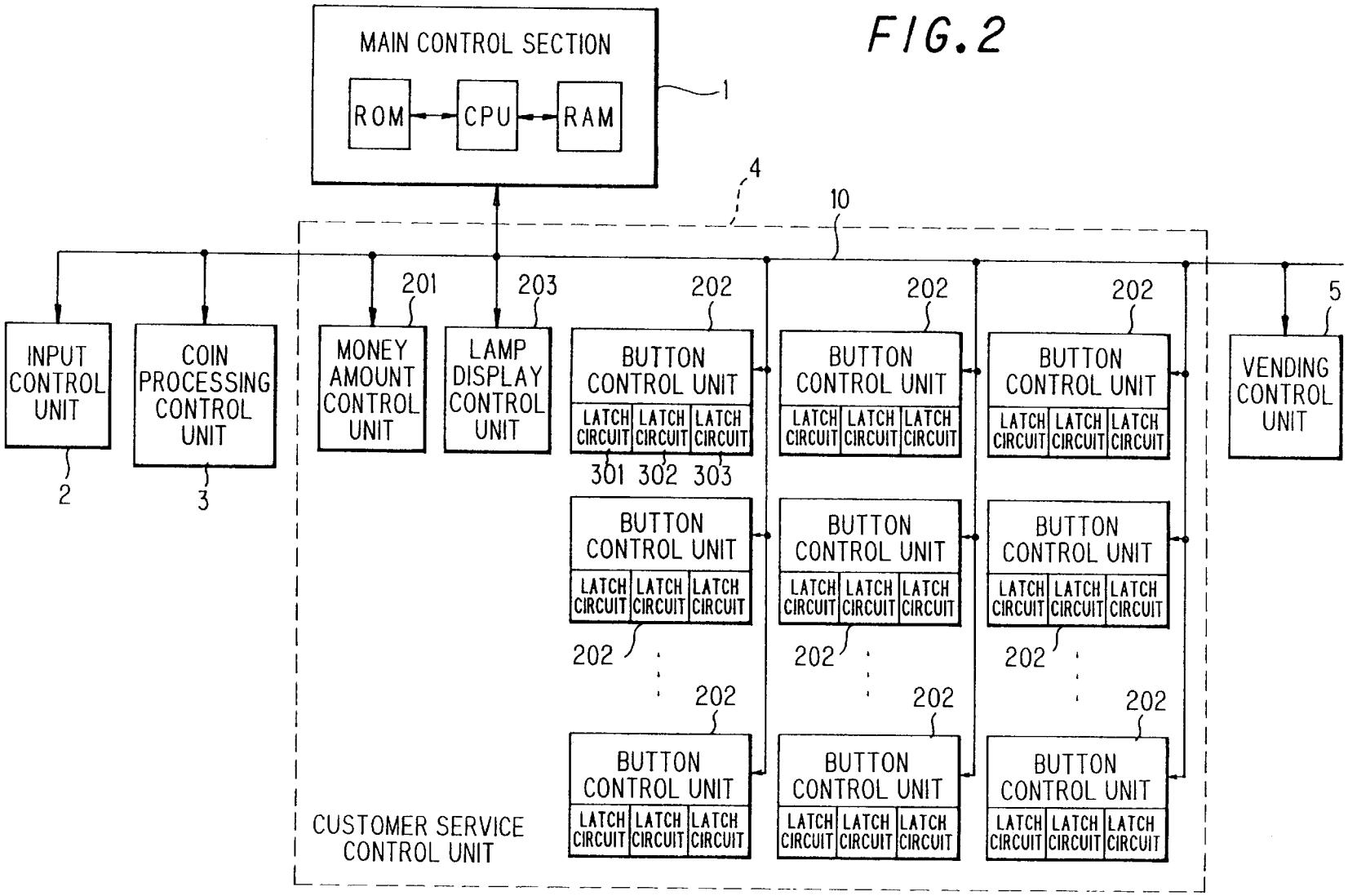
FIG. 2 is a block diagram that illustrates a control unit in the communication device of the automatic vending machine in FIG. 1.

In FIG. 2, the customer service control unit 4 includes a money amount display control unit 201 controlling a money amount display unit 101, a button control unit 202 controlling an item selection button 102, and a lamp display control unit 203 controlling a lamp 103. The number of the item selection buttons 102 may be several tens (e.g. 30) depending on sorts of canned drinks in the automatic vending machine. The number of the button control units 202 may also be several tens (e.g. 30), which is equal to the number of the item selection buttons. The button control units 202 are connected through a data input/output line 10 to the main control unit 1 together with the money amount display control unit 201 and the lamp display control unit 203 as a different role terminal. When the main control unit 1 communicates with the customer service control unit 4, the communication can be carried out in the form of a telegraphic or networking message including a main address to represent the customer service control unit 4 itself and a supplemental address to represent the button control unit 202 in the customer service control unit 4, whereby the main control unit 1 can be easily accessible to any one of the button control units 202.

The control data which is stored in the ROM of the main control unit 1 includes such contents that it may allow or prohibit the transmission right of the button control units 202. That is, first control data includes such contents that it may allow or prohibit the transmission right of the button control units 202 itself, and a logical value becomes "1" when the transmission right of the button control units 202 itself is allowed and it becomes "0" when the transmission right of the button control units 202 itself is prohibited. Usually, same type automatic vending machines have same item selection buttons 102, but the item selection buttons 102 which are installed in the same position of the same type of automatic vending machines may be used or unused by specifications or installed locations of the automatic vending machines. The first control data can cope with the situation. A second control data includes such contents that it may allow or prohibit the transmission right of the button control unit 202 when "sold out" lamp on the item selection button 102 is turned on. A logical value becomes "1" when the transmission right of the button control units 202 is allowed and it becomes "0" when the transmission right of the button control units 202 is prohibited. The second control data can cope with the situation that pressing an item selection button 102 corresponding to sold-out item should be invalid. A third control data includes such contents that it may allow or prohibit the transmission right of the button control unit 202 when "sales possible" lamp on the item selection button 102 is turned on. A logical value becomes "1" when the transmission right of the button control units 202 is allowed and it becomes "0" when the transmission right of the button control units 202 is prohibited. The third control data can cope with the situation that pressing an item selection button 102 corresponding to sales-possible item should be valid.

The button control units 202 have latch circuits 301, 302, and 303 which store the first to third control datas which are transmitted from the main control unit 1 and may be a part of RAM. The plural button control units 202 are set to have or not to have the transmission right based on a value of the latch circuits 301, 302, and 303. The ROM, CPU, RAM and latch circuits 301, 302, and 303 correspond to means of the button control units 202.

When an electric power of the automatic vending machine is turned on, the main control unit 1 initializes each unit in accordance with a read-out result of initialization order from the ROM, and transmits the first to third control data in the form of the telegraphic message through the data input/output line 10 to the button control units 202 in order. After that, the button control units 202 are set to have or not to have the transmission right to the main control unit 1 based on a latch result of the first to third control data. The first to third control data has a value corresponding to the specification of each automatic vending machine. For example, where the first to third control data is "101", the corresponding button control unit transmits certain data to the main control unit 1 when coins are put in the coin slot, the sold-out lamp on the item selection button is turned off, the sales-possible lamp is turned on the corresponding button control unit, and the item selection button 102 is pressed.

As described above, a plurality of the button control units 202 is set to have or not to have the transmission right by the main control unit 1 and where the communication is carried out between the main control unit 1 and the button control units 202 by contention type protocol. Unnecessary communication from the terminal control units can be prevented without losing such merits as short communication time. These advantages can be obtained in the terminal control units other than the button control units. Also, the transmission right for a plurality of terminal control units can be set in a certain period of time (e.g. every three months which are the change of seasons) besides the turn-on of electric source in the automatic vending machine.

According to the invention, the following advantages can be obtained.

The first embodiment of the invention has terminal control units each of which controls each unit of the automatic vending machine. The main control unit controls the terminal control units and carries out communication by contention type protocol in which the main control unit and the terminal control unit have equal transmission right. The main control unit transmits a control data to allow or prohibit transmission from the terminal control units at a predetermined timing to the terminal control units. The terminal control units set the inside of the terminal control units to the conditions corresponding to the control data, whereby incorrect operations and incorrect vending can be prevented because some of the terminal control units are set to have the transmission right and the other terminal control units are set not to have the transmission right.

In a second embodiment of the present invention includes a predetermined timing when the automatic vending machine is initialized by introduction of electric power, whereby the terminal control units can be set to the functions corresponding to the specification of each automatic vending machine simultaneously when the electric power is turned on.

In a third embodiment of the present invention includes that the terminal control units are button control units which control the item selection buttons.

In a fourth embodiment of the present invention includes that the control data includes contents to allow or prohibit transmission from the button control units to the main control unit when the item selection buttons are pressed.

In a fifth embodiment of the present invention includes that the control data includes contents to allow or prohibit transmission from the button control units to the main control unit when the item selection buttons are pressed in the state that "sold out" is displayed.

The communication device for automatic vending machine which is the sixth embodiment of the invention, said control data includes contents to allow or prohibit transmission from the plural button control units to the main control unit when the plural item selection buttons are pressed in the state that "sales possible" is displayed.

According to the third to sixth embodiments, some of the button control units are set to have the transmission right and the other button control units are set not to have the transmission right in accordance with sorts of the item selection buttons and presence or absence of "sold out" and "sales possible" display.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims.

What is claimed is:

1. A communication device for an automatic vending machine comprising:

a plurality of terminal control units, each of which controls an unit of the automatic vending machine, and a main control unit which collectively controls a plurality of the terminal control units, and carries out communication by a contention type protocol in which the main control unit and the plural terminal control units have equal transmission right, wherein said main control unit comprises a means for transmitting, to a plurality of the terminal control units at a predetermined timing, a control data to allow or prohibit transmission from the terminal control units, wherein said plural terminal control units comprise a means for setting an inside of the terminal control units to conditions corresponding to the control data, and wherein said predetermined timing is when the automatic vending machine is initialized by turning on electric power.

2. A communication device for an automatic vending machine comprising:

a plurality of terminal control units, each of which controls an unit of the automatic vending machine, and a main control unit which collectively controls a plurality of the terminal control units, and carries out communication by a contention type protocol in which the main control unit and the plural terminal control units have equal transmission right, wherein said main control unit comprises a means for transmitting, to a plurality of the terminal control units at a predetermined timing, a control data to allow or prohibit transmission from the terminal control units, wherein said plural terminal control units comprise a means for setting an inside of the terminal control units to conditions corresponding to the control data, wherein said terminal control units are a plurality of button control units that control a plurality of item selection buttons, and wherein said control data includes contents to allow or prohibit transmission from the button control units to the main control unit when the item selection buttons are pressed.

3. A communication device for an automatic vending machine comprising:

a plurality of terminal control units, each of which controls an unit of the automatic vending machine, and a main control unit which collectively controls a plurality of the terminal control units, and carries out communication by a contention type protocol in which the main control unit and the plural terminal control units have equal transmission right, wherein said main control unit comprises a means for transmitting, to a plurality of the terminal control units at a predetermined timing, a control data to allow or prohibit transmission from the terminal control units, wherein said plural terminal control units comprise a means for setting an inside of the terminal control units to conditions corresponding to the control data, wherein said terminal control units are a plurality of button control units that control a plurality of item selection buttons, and wherein said control data includes contents to allow or prohibit transmission from the button control units to the main control unit when the item selection buttons are pressed in the state that "sold out" is displayed.

4. A communication device for an automatic vending machine comprising:

a plurality of terminal control units, each of which controls an unit of the automatic vending machine, and a main control unit which collectively controls a plurality of the terminal control units, and carries out communication by a contention type protocol in which the main control unit and the plural terminal control units have equal transmission right, wherein said main control unit comprises a means for transmitting, to a plurality of the terminal control units at a predetermined timing, a control data to allow or prohibit transmission from the terminal control units, wherein said plural terminal control units comprise a means for setting an inside of the terminal control units to conditions corresponding to the control data, wherein said terminal control units are a plurality of button control units that control a plurality of item selection buttons, and wherein said control data includes contents to allow or prohibit transmission from the button control units to the main control unit when the item selection buttons are pressed in the state that "sales possible" is displayed.

* * * * *